US007762901B1

(12) United States Patent
Atkinson et al.

(10) Patent No.: US 7,762,901 B1
(45) Date of Patent: Jul. 27, 2010

(54) WATER PLAY STRUCTURES AND METHODS UTILIZING INTERCHANGEABLE PLAY FEATURES AND SECURITY MEASURES

(76) Inventors: Dean M. Atkinson, 207 River Rd., Orange Park, FL (US) 32073; Duane A. Atkinson, 10695 Grayson Ct., Jacksonville, FL (US) 32220

( * ) Notice: Subject to any disclaimer, the term of this patent is extended or adjusted under 35 U.S.C. 154(b) by 345 days.

(21) Appl. No.: 11/870,761

(22) Filed: Oct. 11, 2007

Related U.S. Application Data

(60) Provisional application No. 60/829,440, filed on Oct. 13, 2006.

(51) Int. Cl.
*A63H 23/16* (2006.01)
*A63H 23/00* (2006.01)

(52) U.S. Cl. ..... 472/128; 472/136

(58) Field of Classification Search ..... 472/117, 472/128, 135, 136; 482/35–37
See application file for complete search history.

(56) References Cited

U.S. PATENT DOCUMENTS

| | | | | | |
|---|---|---|---|---|---|
| 5,554,074 | A * | 9/1996 | Von Parrish | ..... | 472/116 |
| 5,853,332 | A * | 12/1998 | Briggs | ..... | 472/128 |
| 5,865,680 | A * | 2/1999 | Briggs | ..... | 472/128 |
| 5,967,901 | A * | 10/1999 | Briggs | ..... | 472/128 |
| 6,089,987 | A * | 7/2000 | Briggs | ..... | 472/128 |
| 6,165,106 | A * | 12/2000 | McBride et al. | ..... | 482/35 |
| 6,786,830 | B2 * | 9/2004 | Briggs et al. | ..... | 472/128 |

* cited by examiner

*Primary Examiner*—Kien T Nguyen
(74) *Attorney, Agent, or Firm*—Allen, Dyer, Doppelt, Milbrath & Gilchrist, P.A.

(57) ABSTRACT

A water play structure for children includes an elevated platform having an upper horizontal rail and vertical pickets between the rail and the platform free of any horizontal members so as to reduce the risk that children will climb across the railing and fall from the platform, the structure further including water features such as a canopy supported upon the elevated platform and dimensioned to provide a flow of water that falls downwardly across a portion of the platform.

9 Claims, 3 Drawing Sheets

WATER PLAY STRUCTURES AND METHODS UTILIZING INTERCHANGEABLE PLAY FEATURES AND SECURITY MEASURES

CROSS-REFERENCE TO RELATED APPLICATION

This application incorporates by reference and claims priority to Provisional Application Ser. No. 60/829,440 for "Water Play Structures and Methods Utilizing Interchangeable Play Features and Security Measures," having a filing date of Oct. 13, 2006, and commonly owned with this application.

FIELD OF THE INVENTION

The present invention is directed to water play structures and related methods.

BACKGROUND OF THE INVENTION

A number of water play structures and methods are known in the prior art. One such arrangement is disclosed in US Patent Publication 2002/0040499 which describes a supervisory viewing feature that employs a flexible webbing having rectangular openings at least one half inch in dimension to permit supervisory viewing of elevated portions of the place structure, in order that a lifeguard or other supervisor standing on the ground can observe children playing on the elevated platform.

SUMMARY OF THE INVENTION

The present invention is directed to water play structures that utilize an elevated platform and a number of novel features. One embodiment utilizes supervisory viewing features comprising in one example vertical stainless steel pickets without intermediate horizontal bars that would enable a child to climb in a manner that may endanger the child. However, the structure also includes openings in the line of pickets to permit water play features to extend through the line of pickets during play. Another supervisory feature is the use of flexible netting between the elevated platform and the ground and underneath access stairs in order to reduce injuries.

The water play structures and methods in accordance with the present invention also utilize in combination with the supervisory viewing features described above, means for permitting various water play features to be interchangeably mounted on pipes adjoining the play structure. A mushroom-shaped canopy is supported on the elevated platform as one water play feature.

DETAILED DESCRIPTION

Figure 1:
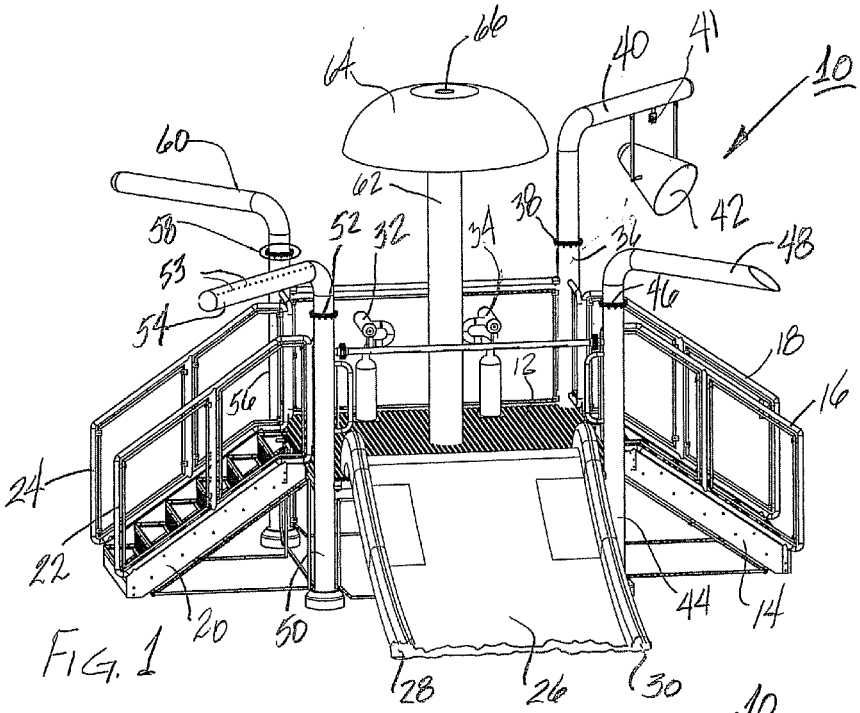
FIG. 1 is a perspective view, partially cut away, of a water play structure in accordance with the present invention.

First noting FIG. 1, the water play structure is referred to generally with the reference numeral 10 and includes an elevated platform 12 fabricating from stainless steel or similar noncorrosive material. A first stairway 14 having guardrails 16, 18 is positioned alongside the structure 10 so that children may climb to the elevated platform 12. In a similar manner, a second stairwell 20 is provided, and includes handrails 22, 24 also permitting children to climb up to or down from the elevated platform 12. The structure 10 also includes a water slide 26 position between opposing rails 28, 30.

Figure 6:
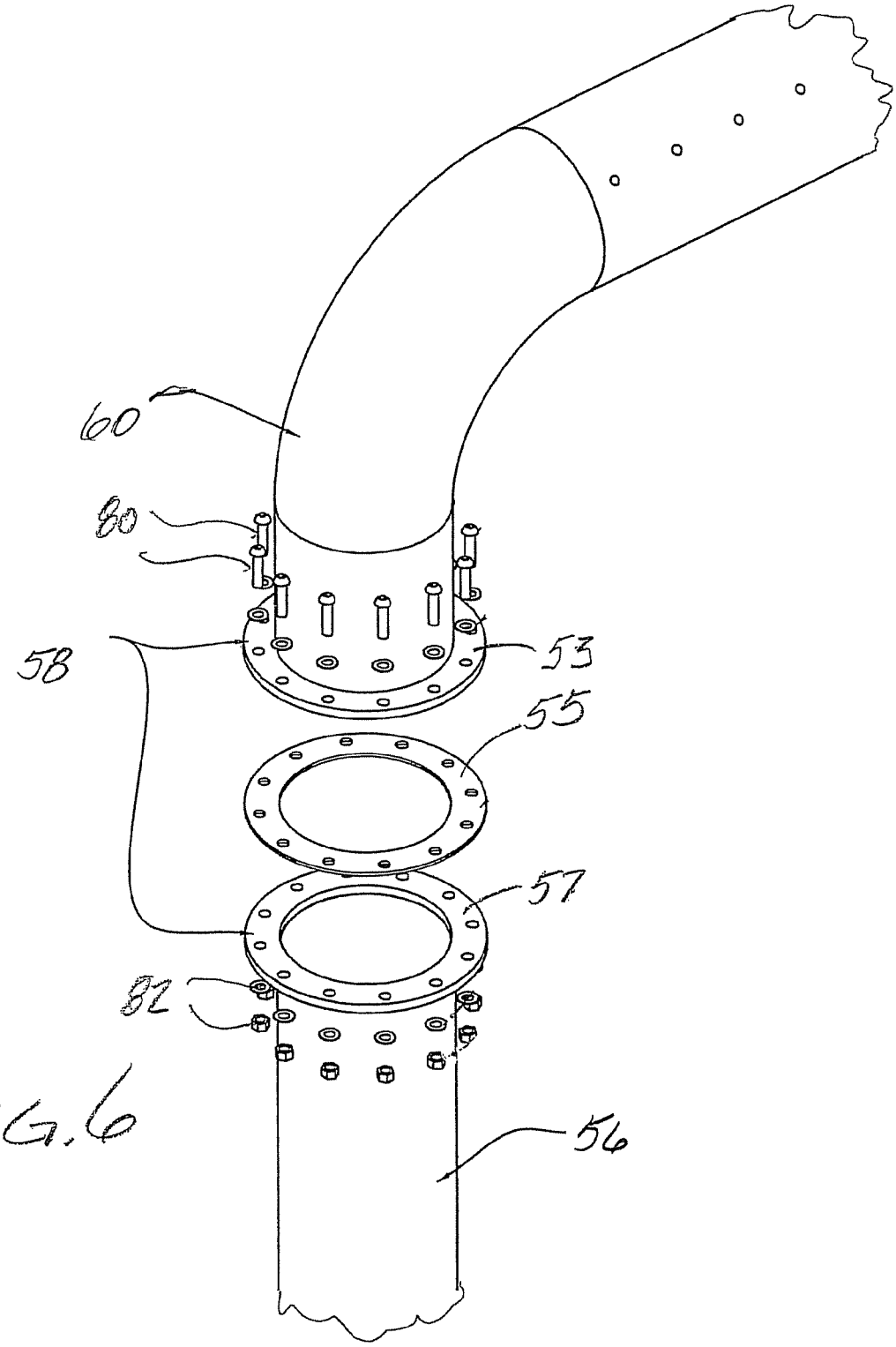
FIG. 6 is an exploded prospective view of a portion of the structure of FIGS. 1-5 illustrating the manner in which various water play features may be rotated to different positions or interchanged with other water play features in a facile manner.

In order to provide an exciting and satisfying play experience for children, the water play structure 10 is provided with numerous water play features including water cannons 32, 34 fitted to the elevated platform 12 and communicating with a source of water. The water play structure 10 also includes elevated water play features 40, 48, 54 and 60 which are mounted upon respective vertical pipes 36, 44, 50 and 56 via corresponding rotatable couplings 38, 46, 52 and 58 that are described in greater detail below with reference to FIG. 6. Each of the water play features 40, 48, 54 and 60 have a horizontally extending portion with sprinklers, hose, drip features, a tip bucket or the like that sprays or pours downwardly to enhance the enjoyment of the children using the water play structure 10. By way of example, the water play feature 40 connected to coupling 38 to pipe 36 includes a nozzle that is directed downwardly toward a tipping bucket 42; the tipping bucket is constructed in a known manner so as to tip over when the amount of water reaches a certain level in the bucket 42, thereby spraying the children below. Of course, it will be understood by those skilled in the art that the water play feature 40 has a hollow channel therein communicating with the hollow channel of the pipe 36 to which water is delivered from a supply source.

Likewise, water spray feature 48 is provided with means for spraying water downwardly as received from the pipe 44, and water spray feature 54 permits the spraying of water under pressure out of apertures 53 as received from the vertical pipe 50. Water spray feature 60 receives water from vertical pipe 56 and also includes means for permitting water to be sprayed or dripped downwardly.

The supervisory viewing feature of the present invention will now be described with referenced to FIG. 2. It will be noted that FIG. 2 depicts the water play structure 10 of FIG. 1 rotated 180 degrees, except that the water play features 40, 54 and 60 have been moved in accordance with another aspect of this invention as described further below with respect FIGS. 3-6.

Figure 2:
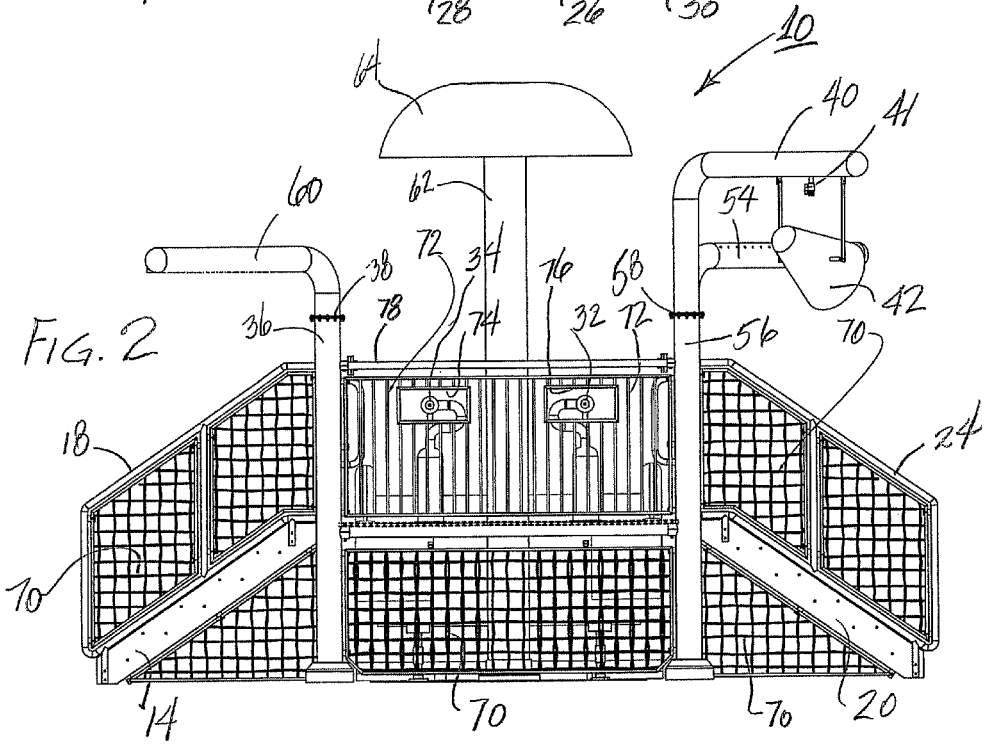
FIG. 2 is a side elevation of the play structure shown in FIG. 1 as rotated 180 degrees, but with certain water play features mounted on different pipes adjoining the mean structure.
Figure 3:
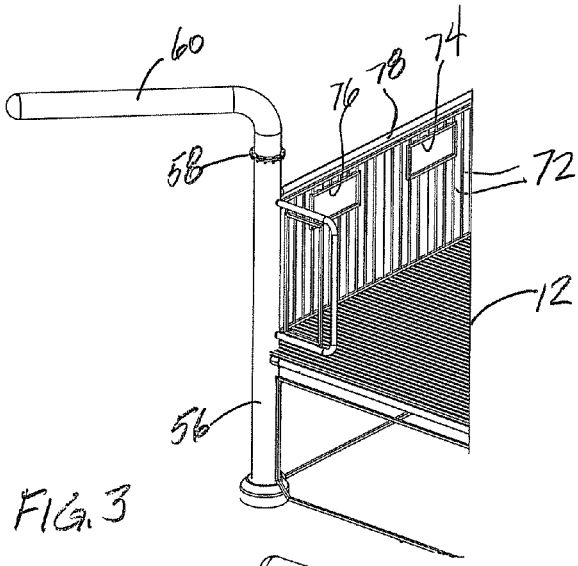
FIGS. 3, 4 and 5 are cross-sectional prospective views of a portion of the structure shown in FIGS. 1 and 2 with FIG. 3 depicting a first water play feature in a first position, FIG. 4 illustrating the first water play feature rotated to a second position and with FIG. 5 illustrating the interchangeability of a second water play feature for the first water play feature of FIGS. 3 and 4.
Figure 4:
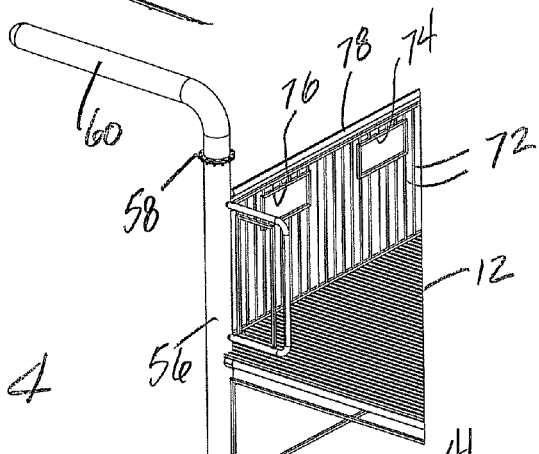

With continued reference to FIG. 2, the water play structure 10 is provided with means reducing falls from the platform 12 comprising an upper horizontal rail 78 and vertical stainless steel pickets 72 of a very thin gauge about portions of the platform 12 that guards against falls while permitting easy viewing of children playing on the platform. As described in the aforementioned patent publication, a cross-hatched vinyl flexible material 70 may be inserted in the other openings that are not as crucial to viewing children at play as that on the upper surface of the elevated platform 12. It will be appreciated by those skilled in the art that the extremely thin vertical pickets 72 have no cross members (except the openings 74 and 76 as described below), thereby making it extremely difficult for a child to climb upwardly and over the rail 78 and be placed in a dangerous position. Further, however, the thinness of the rails permits easy viewing of children playing on the upper surface of the platform 12.

As discussed briefly above, the water play structure 10 includes two generally rectangular openings 72, 76 having horizontal structures at an upper level of the pickets 72 in order to permit an unobstructed stream of water to be emitted from the water cannons 32, 34 (FIG. 2). The water cannons 32, 34 are positioned within the rectangular openings 72, 76 so as to reduce the likelihood that a child will use the horizontal structural features of the openings 72, 76 to crawl over the rail 78.

Another supervisory feature that permits supervision comprises flexible netting 70 extending from the platform to the ground and between the rails of the stairs 18, 24 and the ground.

As also shown in FIGS. 1 and 2, the water play structure also includes a centrally-positioned mushroom-shaped water play feature including a vertical pipe 62 and an upper canopy 64 having a central hole 66 through which water passes out of the pipe 62 and then along the surface of the canopy 64 and across the outer portion of the elevated platform 12. Water flowing from the outer edge of the canopy 64 provides a delightful "barrier" for children attempting to gain the "high ground" represented by the platform 12. It will thus be appreciated that children playing upon the upper surface of the elevated platform 12 may safely enjoy an exciting play experience while being subject to supervisory viewing through the thin stainless steel pickets 72 by a lifeguard or other supervisor on the ground. Without limiting other dimensions and forms of the stainless steel picket 72, a three-quarter inch cylindrical stainless tubing may be installed for the picket 72 on four inch centers. The floor of the elevated platform 12 may be fabricated from appropriate materials such as spaced fiberglass elements having a flat surface, the space between the elements permitting water to drain from the platform 12.

Figure 5:
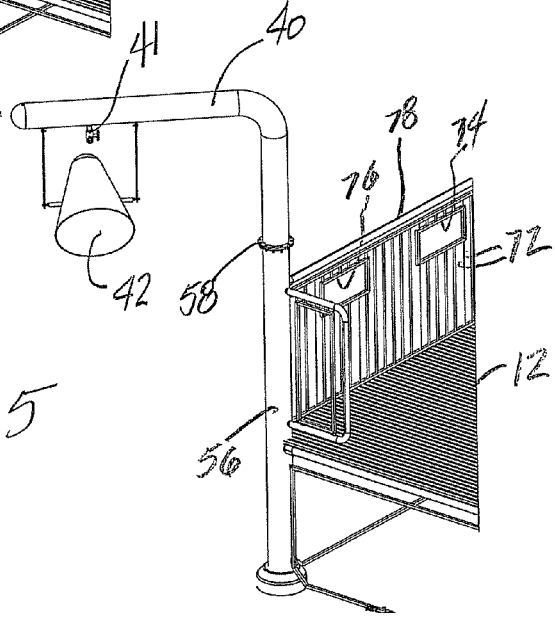

Attention is now drawn to FIGS. 3-6. First noting FIG. 3, the water play structure 60 is shown fitted to the vertical pipe 56 through the coupling 58 in a first position. However, the water play feature 50 may be easily rotated to a second position (FIG. 4) in a facile manner as described below with reference to FIG. 6. Likewise, as depicted in FIG. 5, the water play structure 60 shown in FIGS. 3 and 4 in two different positions may be replaced by one of the other play water features, such as feature 40 having the tipping bucket 42. This is achieved by utilizing a construction for the couplings, such as coupling 58 shown in FIG. 6. The coupling 58 (as with the other couplings 38, 46 and 52) includes a pair of stainless steel flanges 53, 57 that are respectively welded to the corresponding water play feature (such as feature 60 in FIG. 6) and the vertical pipe 56. Each of the flanges 53, 57 includes holes extending therethrough with bolts, washers and nuts fitted at incremental positions around the circumference of the flanges 53, 57. Likewise, a rubber gasket 55 is fitted between the two flanges 53, 57 to permit a water tight seal. It will be appreciated by those skilled in the art that the incrementally spaced holes in the flanges 53, 57 and the gasket 55 permit the mounted water play feature (such as drip feature 60 in FIG. 6) to be easily rotated in a facile manner from one position to another, or to be entirely removed and replaced with another feature. By way of example, the water play structure as shown in FIG. 2 clearly indicates that the position of the tipping bucket water play structure 40 has been moved from one corner of the play structure 10 to another corner, and similar changes and position of the other water play structures have been made. This permits a modification of the configuration of the water play structure 10 to, again, present a different and exciting water play structure for children.

It will of course be appreciated by those skilled in the art that a variety of modifications and changes to the water play structures shown in FIGS. 1-6 may be made without departing from the spirit and scope of the this invention.

What is claimed:

1. A water play structure for children comprising:

a platform;

means for supporting the platform in an elevated position above ground;

guard means for reducing falls from the platform including an upper horizontal rail and vertical pickets between the horizontal rail and the platform;

the pickets are dimensioned and spaced to permit relatively unobstructed viewing of children on the platform by a supervisor at least one opening in the vertical pickets, the opening framed with at least one generally horizontal element; and a water feature positioned in the opening in such a manner as to reduce the risk that children will climb upon the horizontal element.

2. The water play structure for children recited in claim 1 wherein the vertical pickets comprise stainless steel.

3. The water play structure for children recited in claim 1 wherein the vertical pickets comprise a cylindrical stainless tubing having a diameter on the order of about three-quarter inch and positioned on approximately four inch centers.

4. The water play structure for children recited in claim 1 further comprising:

a curved canopy having a generally central hole therein so that water flowing from the hole passes across the outside of the canopy;

means for supporting the canopy above the elevated platform, the canopy supporting means providing a flow of water to the hole in the canopy; and wherein water flowing from the outer edge of the canopy falls downwardly across a portion of the elevated platform.

5. The water play structure for children recited in claim 4 wherein the canopy support means is centrally positioned on the elevated platform, the canopy dimensioned so that water from the canopy falls about the periphery of the elevated platform leaving an interior area of the elevated platform relatively free of water falling from the edge of the canopy.

6. The water play structure for children recited in claim 5 wherein the canopy is mushroom-shaped.

7. The water play structure for children recited in claim 1 further comprising:

a stairwell attached along one side of the elevated platform; and flexible netting fitted between the elevated platform and the ground, and between the stairwell and the ground.

8. A method for installing a water play structure for children comprising the steps of:

providing a platform;

elevating and supporting the platform above ground;

installing an upper guard rail and vertical pickets between the upper guard rail and the elevated platform in order to reduce falls from the platform;

dimensioning and spacing the vertical pickets to permit relatively unobstructive viewing of children on the platform by a supervisor located on the ground;

fitting an opening in the vertical pickets framed with at least one generally horizontal element; and positioning a water feature in the opening in such a manner as to reduce the risk that children will climb upon the horizontal element.

9. The method recited in claim 8 further comprising the steps of:

providing a curved, generally mushroom-shaped canopy having a generally central hole so that water flowing from the hole passes across the outside of the mushroom-shaped canopy;

supporting the canopy above the elevated platform;

providing a flow of water to the hope in the canopy; and dimensioning the canopy and positioning the canopy upon the elevated platform so that water from the canopy falls about the periphery of the elevated platform, leaving an interior area of the elevated platform relatively free of water falling from the edge of the canopy.

* * * * *